US007772758B2

(12) United States Patent
Jeong

(10) Patent No.: US 7,772,758 B2
(45) Date of Patent: Aug. 10, 2010

(54) ELECTRON EMISSION DISPLAY INCLUDING SPACERS WITH LAYERS

(75) Inventor: Seung-Hee Jeong, Yong-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 292 days.

(21) Appl. No.: 11/871,843

(22) Filed: Oct. 12, 2007

(65) Prior Publication Data

US 2008/0106184 A1 May 8, 2008

(30) Foreign Application Priority Data

Nov. 2, 2006 (KR) ..... 10-2006-0107746

(51) Int. Cl.
*H01J 1/62* (2006.01)
*H01J 63/04* (2006.01)

(52) U.S. Cl. ..... 313/498; 313/483; 313/495; 313/496; 313/497; 313/500; 313/238; 313/292

(58) Field of Classification Search ..... None
See application file for complete search history.

(56) References Cited

U.S. PATENT DOCUMENTS 6,657,368 B1 * 12/2003 Kosaka et al. ..... 313/310

FOREIGN PATENT DOCUMENTS

| | | | |
|---|---|---|---|
| JP | 09-073869 | A | 3/1997 |
| JP | 10-040837 | A | 2/1998 |
| JP | 10-275578 | A | 10/1998 |
| JP | 2000-251657 | A | 9/2000 |

* cited by examiner

*Primary Examiner*—Nimeshkumar D. Patel
*Assistant Examiner*—Natalie K Walford
(74) *Attorney, Agent, or Firm*—Knobbe Martens Olson & Bear LLP

(57) ABSTRACT

An electron emission display includes first and second substrates opposing each other, an electron emission unit that is provided on an inner surface of the first substrate, a light emission unit that is provided on an inner surface of the second substrate, and a spacer that is located between the first and second substrate. The spacer includes a main body containing a material whose temperature-coefficient-of-resistance is less than or equal to 3%/° C.

9 Claims, 4 Drawing Sheets

ELECTRON EMISSION DISPLAY INCLUDING SPACERS WITH LAYERS

CROSS-REFERENCE TO RELATED APPLICATION

This application claims the benefit of Korean Patent Application No. 10-2006-0107746, filed on Nov. 2, 2006 in the Korean Intellectual Property Office, the disclosure of which is incorporated herein by reference.

BACKGROUND

1. Technical Field

This disclosure relates generally to an electron emission display, and more particularly, to and an electron emission display comprising spacers that are installed in a vacuum vessel that counteract compression of the vacuum vessel.

2. Description of Related Art

Generally, electron emission elements are classified into those using hot cathodes as electron emission sources and those using cold cathodes as electron emission sources. Known cold cathode electron emission elements include, Field Emitter Array (FEA) electron emission elements, Surface-Conduction-Emission (SCE) electron emission elements, Metal-Insulator-Metal (MIM) electron emission elements, and Metal-Insulator-Semiconductor (MIS) electron emission elements.

A FEA electron emission element includes electron emission regions, and cathode and gate driving electrodes for controlling the electron emission of the electron emission regions. The electron emission regions are formed of a material that can effectively emit electrons under an electric field under vacuum. Examples of such materials have a relatively low work function and/or a relatively large aspect ratio, such as Mo-based materials, Si-based materials, or carbon-based materials (e.g., carbon nanotubes, graphite, and/or diamond-like-carbon). Electron emission regions formed from Si-based materials and/or Mo-based materials are typically formed with a tip structure.

The electron emission elements are arrayed on a first substrate to form an electron emission device. The electron emission device is combined with a second substrate on which a light emission unit having a phosphor layer and an anode electrode are formed, thereby forming an electron emission display. In the electron emission display, the first and second substrates are sealed together at their peripheries using a sealing member, for example, comprising frit bars, to form a vacuum vessel. The interior of the vacuum vessel is evacuated to a pressure of about $10^{-6}$ Torr.

The pressure differential between the interior and exterior of the vacuum vessel results in a high compression force, which is proportional to the display size. Therefore, a plurality of spacers is provided in the vacuum vessel to counteract the compression force and to maintain a uniform gap between the first and second substrates. Typically, the spacers are formed from a dielectric such as glass or ceramic to prevent short circuits between the driving electrodes provided on the first substrate and the anode electrode provided on the second electrode.

In a typical electron emission display, heat generated from the driving electrodes is transmitted to the spacers. The heating causes a change in resistance in the spacers, which distorts the electric field around the spacers. Consequently the paths of the electron beams emitted from the electron emission regions and accelerated toward the anode electrode deviate from their intended paths and/or the electron beams are diffused.

These changes in the electron beam path around the spacers reduce the accuracy of color reproduction on portions of the display proximal to the spacers. Consequently, temperature variations within the display change the appearance of the display from its initial state.

SUMMARY OF THE INVENTION

Embodiments disclosed herein provide an electron emission display having a spacer that can suppress an electron beam distortion phenomenon and a visible variation in appearance by minimizing a resistance variation due to a temperature variation.

In an exemplary embodiment, an electron emission display includes first and second substrates opposing each other, an electron emission unit that is provided on an inner surface of the first substrate, a light emission unit that is provided on an inner surface of the second substrate, and a spacer that is located between the first and second substrate, wherein the spacer includes a main body containing a material with a temperature-coefficient-of-resistance that is equal to or less than 3%/° C. The material with a temperature-coefficient-of-resistance that is equal to or less than about 3%/° C. may be a noble metal. The noble metal may include at least one of materials selected from the group consisting of gold (Au), silver (Ag), iridium (Ir), palladium (Pd), osmium (Os), rhodium (Rh), and ruthenium (Ru). The main body may further include at least one of ceramic and glass.

The spacer may further include a secondary electron emission preventing layer formed on a side surface of the main body. The secondary electron emission preventing layer may be formed of a material whose second electron emission coefficient is substantially 1, including at least one of materials selected from the group consisting of a chrome oxide, a nickel oxide, and copper oxide. Alternatively, the secondary electron emission preventing layer may be formed of diamond-like-carbon.

Some embodiments provide an electron emission display comprising: first and second substrates opposing each other; an electron emission unit disposed on an inner surface of the first substrate; a light emission unit disposed on an inner surface of the second substrate; and a spacer disposed between the first and second substrate, wherein the spacer comprises a main body, and the main body comprises a material with a temperature-coefficient-of-resistance of less than or equal to about 3%/° C.

In some embodiments, the material with a temperature-coefficient-of-resistance less than or equal to about 3%/° C. comprises a noble metal. In some embodiments, the noble metal comprises at least one of gold (Au), silver (Ag), iridium (Ir), palladium (Pd), osmium (Os), rhodium (Rh), and ruthenium (Ru).

In some embodiments, the main body further comprises ceramic. In some embodiments, the main body further comprises glass. In some embodiments, the main body further comprises ceramic and glass.

Some embodiments further comprise a secondary electron emission preventing layer formed on at least one side surface of the main body. In some embodiments, the secondary electron emission preventing layer comprises a material with a second electron emission coefficient of substantially about 1. In some embodiments, the second electron emission preventing layer comprises at least one of a chromium oxide, a nickel oxide, and a copper oxide. In some embodiments, the secondary electron emission preventing layer comprises diamond-like-carbon.

In some embodiments, the electron emission unit comprises at least one of a field emitter array (FEA) electron emission element, a surface-conduction-emission (SCE) electron emission element, a metal-insulator-metal (MIM) electron emission element, and a metal-insulator-semiconductor (MIS) electron emission element.

Some embodiments provide a spacer for an electron emission display comprising: an electrically insulating main body comprising a top, a bottom, and at least one side; and a secondary electron emission preventing layer disposed on the at least one side of the main body, wherein the main body comprises a material with a temperature-coefficient-of-resistance of less than or equal to about 3%/° C., and the spacer has sufficient strength to counteract a compression force and to maintain a uniform gap between a first substrate and second substrate of an electron emission display.

In some embodiments, the material with a temperature-coefficient-of-resistance of less than or equal to about 3%/° C. comprises at least one of glass and ceramic. In some embodiments, the material with a temperature-coefficient-of-resistance of less than or equal to about 3%/° C. has a temperature-coefficient-of-resistance of from about 2%/° C. to about 3%/° C.

In some embodiments, the secondary electron emission preventing layer comprises a material with a secondary electron emission coefficient of about 1. In some embodiments, the secondary electron emission preventing layer comprises at least one of a chromium oxide, a nickel oxide, a copper oxide, a carbon-based material, amorphous carbon, and diamond-like-carbon. In some embodiments, the secondary electron emission preventing layer further reduces charge buildup on the spacer.

In some embodiments, the spacer is a rectangular solid. In some embodiments, the main body comprises a plurality of sides and the secondary electron emission preventing layer is disposed on at least two sides of the main body.

Some embodiments provide a method for improving an accuracy of color reproduction in an electron emission display, the method comprising: disposing a spacer between a first substrate and a second substrate of an electron emission display, wherein the spacer comprises a main body, and the main body comprises a material with a temperature-coefficient-of-resistance of less than or equal to about 3%/° C.

DETAILED DESCRIPTION OF CERTAIN EMBODIMENTS

Figure 1:
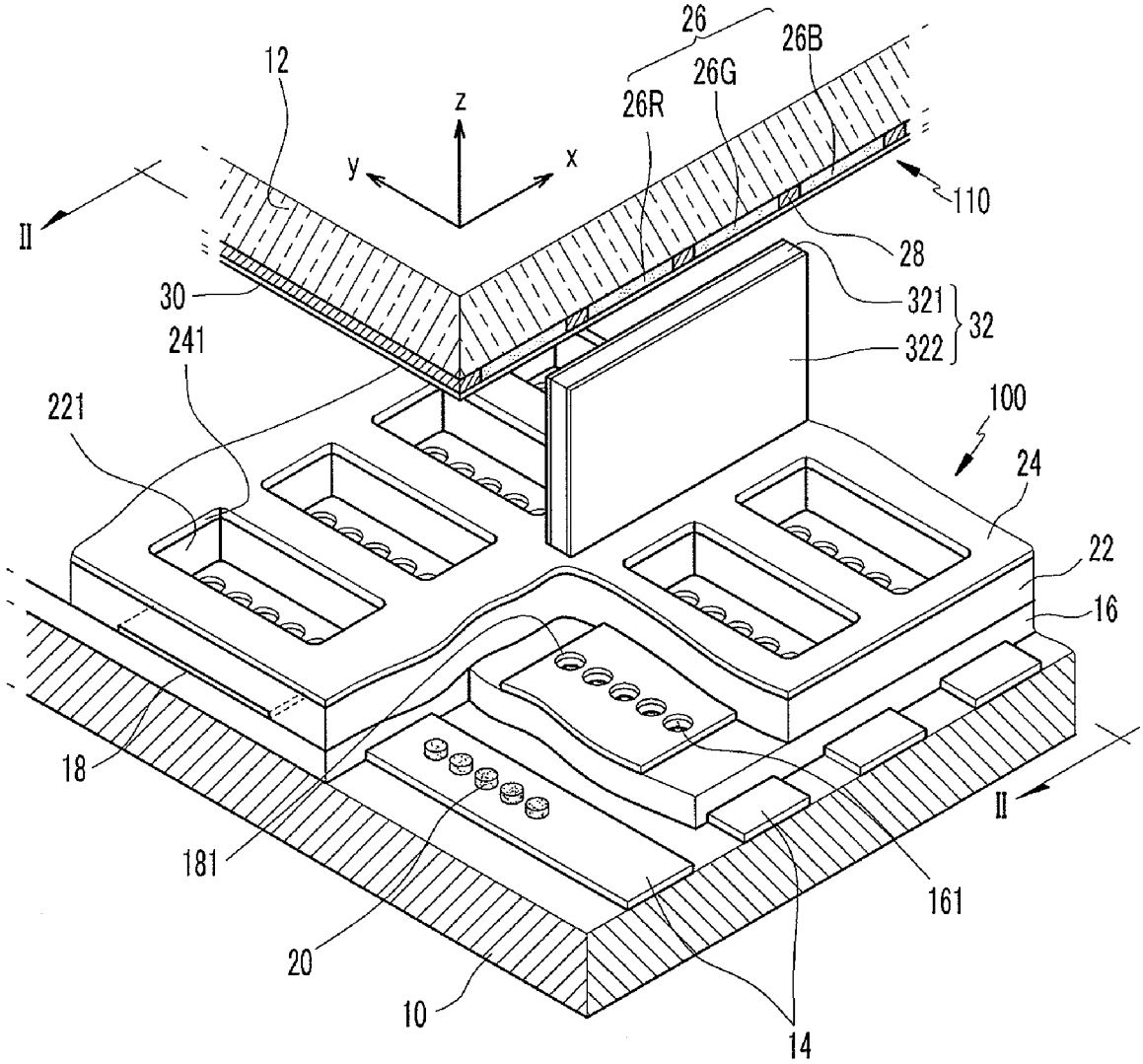
FIG. 1 is a partially exploded perspective view of an embodiment of an electron emission display.

With reference to the accompanying drawings, certain embodiments are described in sufficient detail for those skilled in the art to implement. As those skilled in the art would realize, the described embodiments may be modified in various different ways, all without departing from the spirit or scope of the disclosure. Wherever possible, like reference numbers in the drawings to refer to similar or like parts.

Figure 2:
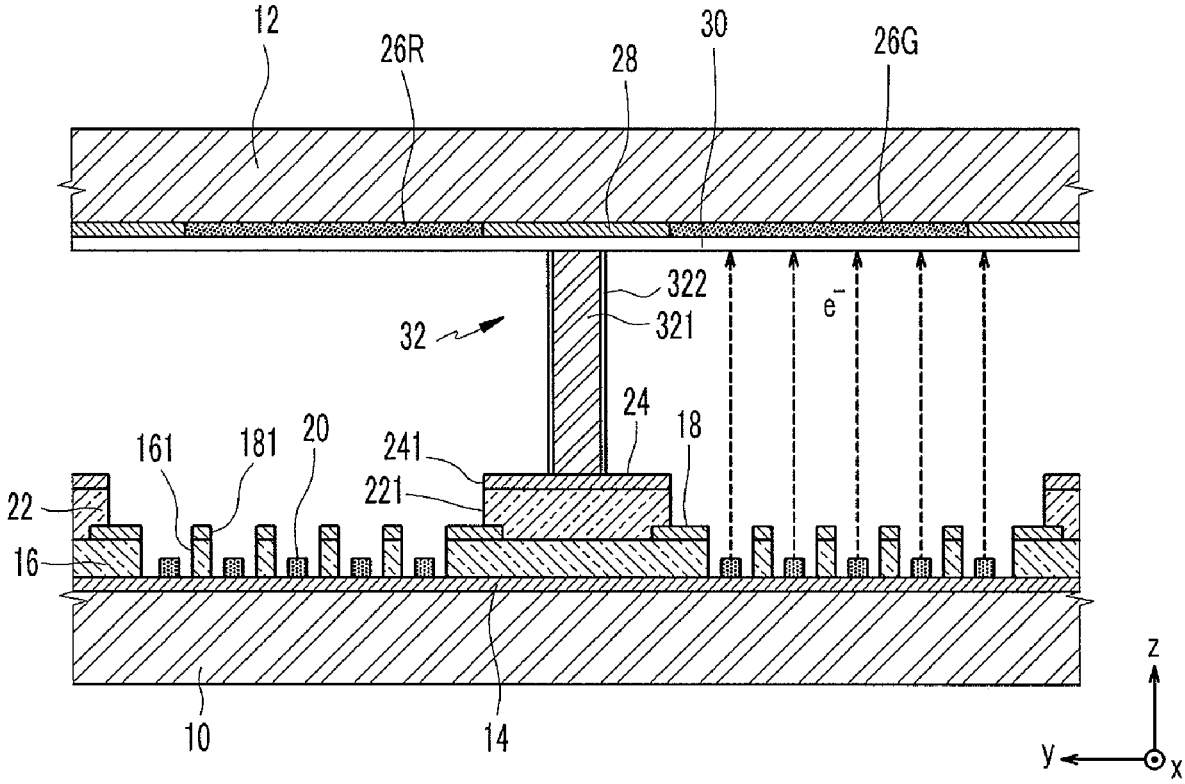
FIG. 2 is a cross-sectional view taken along line II-II of FIG. 1.

FIG. 1 is a partially exploded perspective view of an embodiment of an electron emission display. FIG. 2 is a cross-sectional view taken along line II-II of FIG. 1. Referring to FIGS. 1 and 2, the illustrated electron emission display includes first 10 and 12 second substrates opposing each other, generally in parallel at a predetermined distance. The first 10 and second 12 substrates are sealed together at their peripheries using a sealing member (not shown) to provide a vacuum vessel. The interior of the vacuum vessel is evacuated to about $10^{-6}$ Torr.

An electron emission unit 100 having an array of electron emission elements is provided on an inner surface of the first substrate 10. A light emission unit 110 having a phosphor layer and an anode electrode is provided on an inner surface of the second substrate 12. An electron emission display is formed by combining the first substrate 10, on which the electron emission unit 100 is provided, and the second substrate 12 on which the light emission unit 110 is provided. The electron emission elements are of any suitable type, for example, FEA electron emission elements, SCE electron emission elements, MIM electron emission elements, MIS electron emission elements, or the like. An electron emission display having FEA elements will be described as an example hereinafter with reference to FIGS. 1 and 2.

A plurality of cathode electrodes 14 are arranged on the first substrate 10 in a stripe pattern extending in a first direction (y-axis in FIG. 1). An insulation layer 16 is formed on an entire surface of the first substrate 10, covering the cathode electrodes 14. A plurality of gate electrodes 18 are formed on the first insulation layer 16 in a stripe pattern extending in a second direction (x-axis in FIG. 1) intersecting the cathode electrodes 14 at generally right angles in the illustrated embodiment. Each intersection of the cathode 14 and gate 18 electrodes corresponds to one unit pixel. A plurality of electron emission regions 20 are formed on the cathode electrodes 14 at each unit pixel.

First openings 161 and second openings 181, corresponding to respective electron emission region 20, are formed in the first insulation layer 16 and the gate electrodes 18, respectively, thereby exposing the electron emission regions 20. Each electron emission region 20 is located on a cathode electrode 14, and disposed within a first 161 opening and a second 181 opening, as best seen in FIG. 2. In this exemplary embodiment, the first 161 and second 181 openings have generally circular horizontal cross sections; however, those skilled in the art will understand that other configurations are used in other embodiments.

The electron emission regions 20 may be formed from a material that emits electrons when an electric field is applied thereto under vacuum, such as a carbonaceous material or a nanoscale material. For instance, the electron emission regions 20 may be formed of carbon nanotubes, graphite, graphite nanofibers, diamond, diamond-like carbon, fullerenes (e.g., $C_{60}$), silicon nanowires, or combinations thereof. Alternatively, the electron emission regions may be formed in a molybdenum-based and/or a silicon-based tip structure. The electron emission regions 20 are arranged in a line generally parallel with the cathode electrodes 14. However, those skilled in the art will understand that other arrangements and or configurations of the electron emission regions 20 are used in other embodiments.

A second insulation layer 22 is formed on the first insulation layer 16, thereby covering a portion of the gate electrodes 18 in the illustrated embodiment. A focusing electrode 24 is formed on the second insulation layer 22. The second insulation layer 22 is located under the focusing electrode 24 and insulates the gate electrodes 18 from the focusing electrodes 24. In the illustrated embodiment, the focusing electrode 24 has a predetermined size and is monolithically formed on the second insulation 22.

As best seen in FIG. 2, third openings 221 and fourth openings 241, through which electron beams pass, are formed in the second insulation layer 22 and the focusing electrode 24, respectively. The third 221 and fourth 241 openings focus electrons emitted from one unit pixel in the illustrated embodiment. In other embodiments, the third 221 and fourth 241 openings have other configurations, for example, may be formed to correspond to the individual electron emission regions 20, thereby focusing electrons emitted from each electron emission region 20.

Next, phosphor layers 26, such as red, green and blue phosphor layers 26R, 26G and 26B, spaced apart from each other are formed on an inner surface of the second substrate 12. A black layer 28 for enhancing the screen contrast is formed between the phosphor layers 26. The phosphor layers 26 are arranged to correspond to the respective unit pixels in the illustrated embodiment.

An anode electrode 30 comprising a metal layer formed of, for example, aluminum is formed on the phosphor 26 and black 28 layers. The anode electrode 30 biases the phosphor layers 26 to a high potential sufficient for accelerating the electron beams. The anode electrode 30 also enhances the screen luminance by reflecting back toward the second substrate 12 visible light emitted from the phosphor layers 26 toward the first substrate 10. Alternatively, the anode electrode 30 may be a transparent conductive layer formed of, for example, indium tin oxide (ITO). In some of these embodiments, the anode electrode is located between the second substrate 12 and the phosphor layer 26. Alternatively, the anode electrode 30 may be formed with both of a transparent conductive layer and a metal layer.

Located between the first 10 and second 12 substrates are spacers 32, which maintain a uniform gap between the first 10 and second 12 substrates, resisting compression of the vacuum vessel even when atmospheric pressure is applied to the vacuum vessel. In the illustrated embodiment the spacers 32 are located at positions corresponding to the black layer 28 so as not to interfere with the light emission of the phosphor layer 26. As best seen in FIG. 2, in the present exemplary embodiment, each spacer 32 includes a main body 321 and a secondary electron emission preventing layer 322 formed on one or more side surfaces of the main body 321. In some embodiments, the main body 321 is formed of a mixture including a basic material such as glass and/or ceramic and a material having a low temperature-coefficient-of-resistance, such as noble metal.

Figure 3:
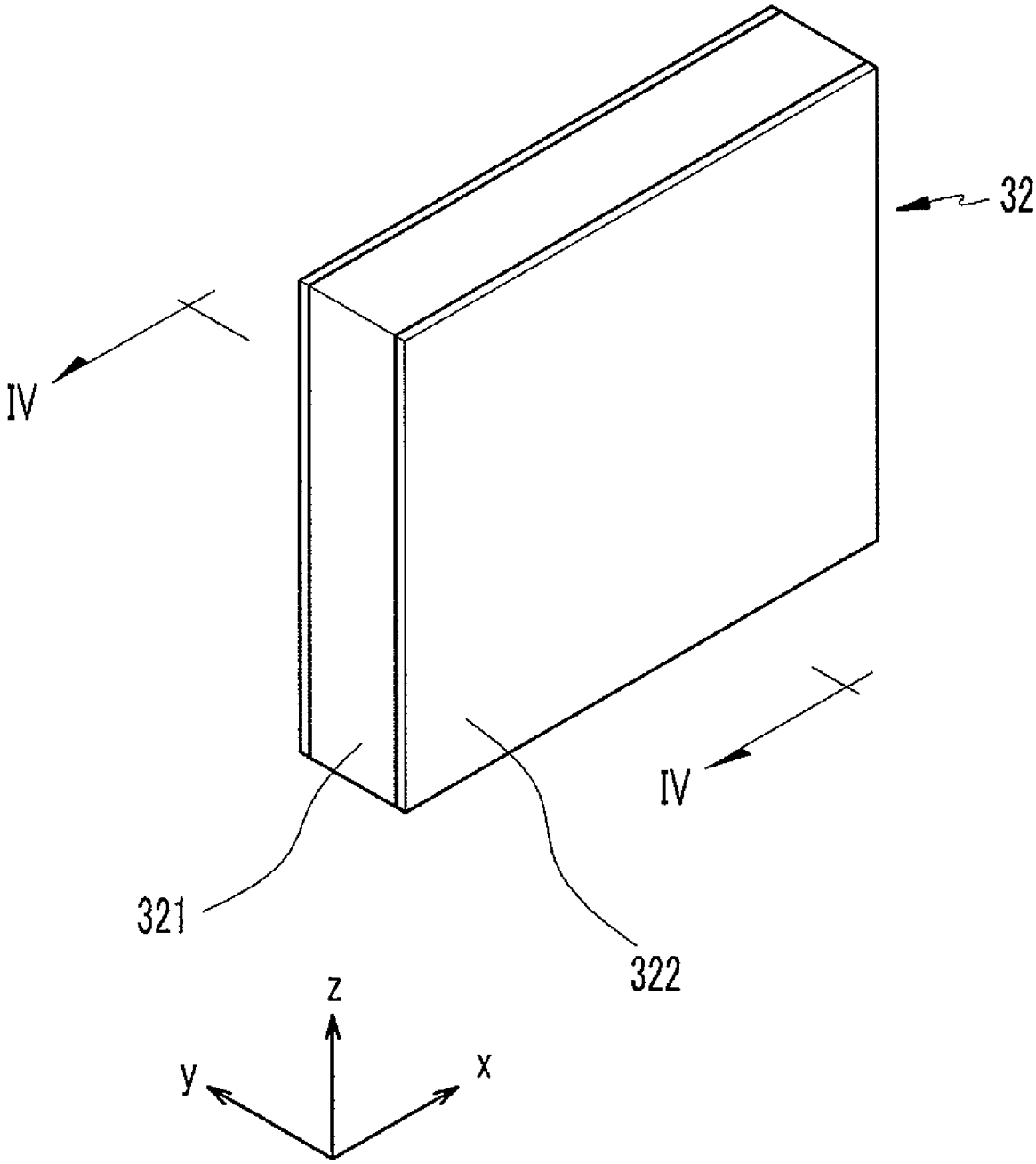
FIG. 3 is a perspective view of an embodiment of a spacer for an electron emission display.
Figure 4:
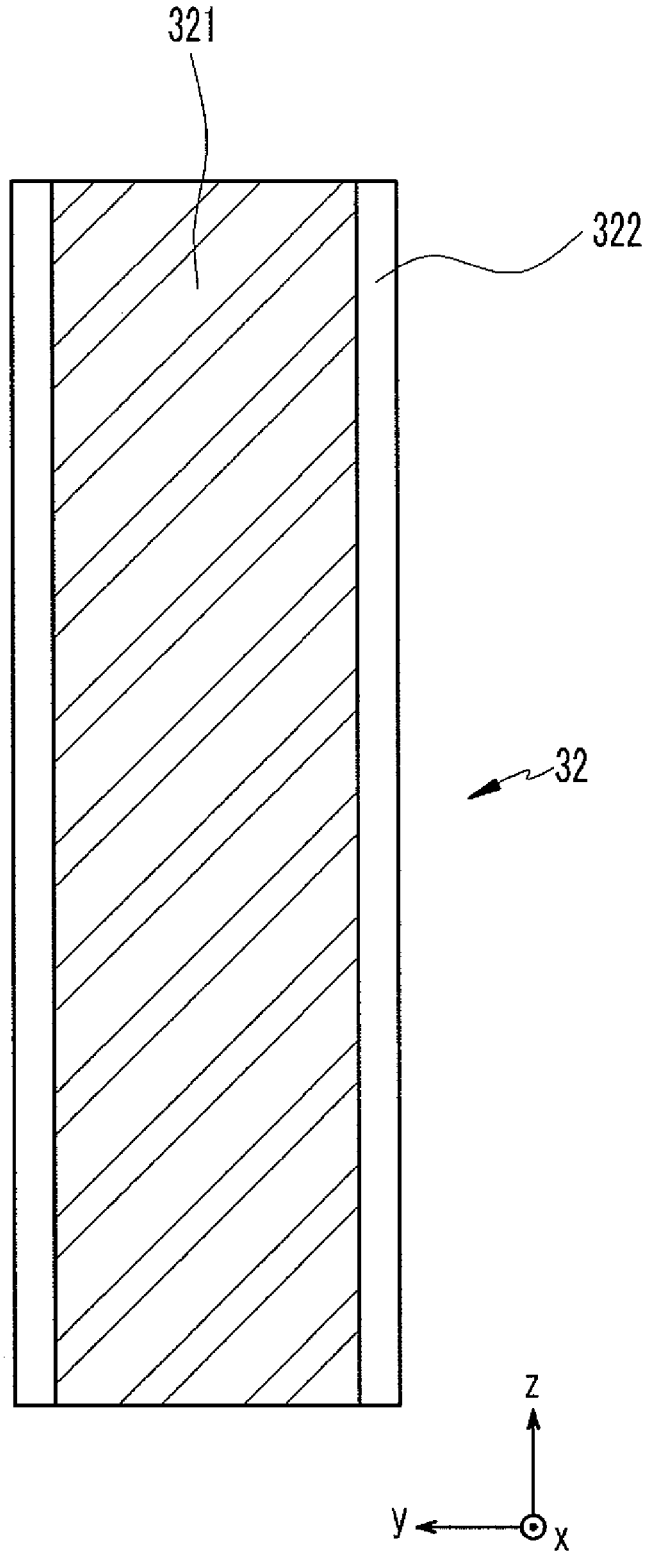
FIG. 4 is a cross-sectional view taken along line IV-IV of FIG. 3.

FIG. 3 is a perspective view of a spacer according to an exemplary embodiment of the present invention and FIG. 4 is a sectional view taken along line IV-IV of FIG. 3. As shown in FIGS. 3 and 4, the main body 321 of the spacer is formed in, for example, a generally rectangular solid or wall shape. As discussed above, the main body 321 is formed of glass and/or ceramic with which one or more noble metals is mixed to adjust a resistivity and a temperature-coefficient-of-resistance of the spacer 32.

Because the spacer 32 is heated during the operation of the electron emission display, its temperature increases. For example, if a temperature-coefficient-of-resistance of a material of the spacer has a high negative value, the resistance decreases as the temperature increases. As a result, an amount of current flowing along the spacer increases, thereby further increasing its temperature. Accordingly, in the present exemplary embodiment, the spacer 32 is formed of a main body material such as ceramic and/or glass to which a material having a temperature-coefficient-of-resistance of less than or equal to about 3%/° C., or from about 2%/° C. to about 3%/° C., for example, at least one noble metal such as gold (Au), silver (Ag), iridium (Ir), palladium (Pd), osmium (Os), rhodium (Rh), and ruthenium (Ru) is added. The noble metals reduce significantly an overall temperature-coefficient-of-resistance of the spacer 32, thereby further reducing changes in resistance caused by temperature variations compared with a spacer formed of only glass and/or ceramic.

The secondary electron emission preventing layer 322 is formed on both side surfaces of the main body 321 of the spacer in the illustrated embodiment. The secondary electron emission preventing layer 322 may comprise a metal oxide with a secondary electron emission coefficient of about 1. For example, the metal oxide may be a chromium oxide (e.g., $Cr_2O_3$), a nickel oxide, and/or a copper oxide. These oxides have relatively low secondary electron emission efficiencies, and consequently, are not easily charged by collisions with electrons emitted by the electron emission regions 20 (FIG. 1). In addition to or instead of metal oxides, a carbon-based material having low second electron emission efficiency may be used for the secondary electron emission preventing layer 332. For example, a material containing amorphous carbon, such as diamond-like-carbon, may be used. The secondary electron emission preventing layer 322 may be formed on one or more of the side surfaces of the main body 321 through a thin film deposition process such as a sputtering process, an electron beam deposition process, and/or an ion plating process.

As the low temperature-coefficient-of-resistance material is added to the spacer 32, changes in resistance of the spacer 32 due to the temperature differential between the first 10 and second 12 substrates is reduced. In addition, the secondary electron emission preventing layer 322 formed on the side surface of the spacer main body 321 can suppress charge buildup on the spacer 32.

In the present exemplary embodiment, the main body 321 of the spacer is formed in a wall shape. Those skilled in the art will understand that other embodiments use different configurations. For example, the main body 321 of the spacer may be formed in a circular or a rectangular pillar shape, or the like in other embodiments.

The following describes an embodiment of a method for operating an electron emission display with reference to FIGS. 1 and 2. The above-described electron emission display is driven when predetermined driving voltages are applied to the cathode 14, gate 18, focusing 24, and anode 30 electrodes of selected pixels. For example, to one of the cathode 14 and gate 18 electrodes is applied with a scan driving voltage, which causes the selected electrode to function as a scan driving electrode. A data driving voltage is applied to the other of the cathode 14 and gate 18 electrodes, which causes the selected electrode to function as a data driving electrode. To the focusing electrode 24 is applied a voltage effective for focusing the electron beams emitted by the electron emission regions 20, for example, a negative direction current voltage of about 0 volt or from about several to about tens of volts. To the anode electrode 30 is applied a voltage effective for accelerating the electron beams, for example, a positive direct current voltage of from about hundreds to about thousands of volts.

Electric fields are generated around the electron emission regions 20 at pixels where a voltage difference between the cathode 14 and gate 18 electrodes is greater than or equal to a threshold value, which causes electron emission from the electron emission regions 20. While passing through the corresponding fourth opening 241 of the focusing electrode 24, the emitted electrons are focused into electron beams, for example, as illustrated in FIG. 2. The electron beams, attracted by the high voltage applied to the anode electrode 30, collide with the phosphor layer 26 of the corresponding unit pixel, thereby exciting the corresponding phosphor layer 26.

As discussed above, electron emission display comprising the spacer 32 described above exhibits reduced variations in resistance because of the reduced temperature-coefficient-of-resistance thereof. The reduced variations in resistance of the spacer 32 improve the uniformity in the output during the operation of the display. Furthermore, coating at least a portion of the spacer 32 with a material having a low secondary electron emission efficiency also effectively prevents build-up of electric charges on the spacer. These effects, individually or in combination, permit more accurate excitation of the phosphor layer, thereby improving color reproduction and display quality.

Those skilled in the art will understand that embodiments of the electron emission display may be used as a light emission device (a light source) for a display device, such as a liquid crystal display panel.

Although exemplary embodiments have been shown and described, it will be appreciated by those skilled in the art that changes may be made without departing from the principles and spirit of the disclosure, the scope of which is defined in the claims and their equivalents.

What is claimed is:

1. An electron emission display comprising:

first and second substrates opposing each other;

an electron emission unit disposed on an inner surface of the first substrate;

a light emission unit disposed on an inner surface of the second substrate; and a spacer disposed between the first and second substrate, wherein the spacer comprises a main body and a secondary electron emission preventing layer which are substantially perpendicular to at least one of the first and second substrates, wherein the main body comprises two opposing side surfaces, wherein the secondary electron emission preventing layer is formed on and substantially completely covers the two opposing side surfaces of the main body, wherein the main body is formed of at least one of glass and ceramic which is mixed with a noble metal, and wherein the noble metal has a temperature-coefficient-of-resistance of less than or equal to about 3%/° C.

2. The display of claim 1, wherein the noble metal comprises at least one of gold (Au), silver (Ag), iridium (Ir), palladium (Pd), osmium (Os), rhodium (Rh), and ruthenium (Ru).

3. The display of claim 1, wherein the secondary electron emission preventing layer comprises a material with a second electron emission coefficient of substantially about 1.

4. The display of claim 3, wherein the second electron emission preventing layer comprises at least one of a chromium oxide, a nickel oxide, and a copper oxide.

5. The display of claim 3, wherein the secondary electron emission preventing layer comprises diamond-like-carbon.

6. The display of claim 1, wherein the electron emission unit comprises at least one of a field emitter array (FEA) electron emission element, a surface-conduction-emission (SCE) electron emission element, a metal-insulator-metal (MIM) electron emission element, and a metal-insulator-semiconductor (MIS) electron emission element.

7. The display of claim 1, wherein the main body comprises two opposing ends, which are substantially perpendicular to the two opposing side surfaces, and wherein one end of the main body contacts an anode electrode.

8. The display of claim 7, wherein the other end of the main body contacts a focusing electrode.

9. The display of claim 1, wherein the secondary electron emission preventing layer comprises first, second, third and fourth surfaces, wherein the first and second surfaces cover the main body, wherein the third and fourth surfaces are opposing the first and second surfaces, and wherein the third and fourth surfaces are continuous.

* * * * *